United States Patent [19]

Odashima

[11] Patent Number: 4,471,727

[45] Date of Patent: Sep. 18, 1984

[54] SEPARATE LUBRICATING SYSTEM FOR OUTBOARD MOTORS

[75] Inventor: Rou Odashima, Hamamatsu, Japan

[73] Assignees: Yamaha Hatsudoki Kabushiki Kaisha; Sanshin Kogyo Kabushiki Kaisha, both of Japan

[21] Appl. No.: 475,837

[22] Filed: Mar. 16, 1983

[30] Foreign Application Priority Data

Apr. 6, 1982 [JP] Japan ..... 57-56042

[51] Int. Cl.[3] ..... F02B 33/04; F01M 1/00

[52] U.S. Cl. ..... 123/73 AD; 123/196 R; 123/196 CP; 184/678; 184/6.4

[58] Field of Search ..... 123/73 AD, 196 R, 196 CP; 184/6.28, 6.4

[56] References Cited

U.S. PATENT DOCUMENTS

| | | | |
|---|---|---|---|
| 1,087,387 | 2/1914 | Lemp | 123/73 AD |
| 2,938,509 | 5/1960 | Carbonero | 123/73 AD |
| 4,142,486 | 3/1979 | Schreier | 123/73 AD |
| 4,388,896 | 6/1983 | Sheridan et al. | 123/73 AD |

*Primary Examiner*—Wendell E. Burns

*Attorney, Agent, or Firm*—Ernest A. Beutler

[57] ABSTRACT

A lubricating system for a two-cycle outboard motor in which lubricant is mixed with the fuel prior to delivery to the fuel bowl of the carburetor in a chamber located externally of the carburetor. The lubricant is supplied by a relatively large storage tank to a relatively smaller delivery tank that is positioned in proximity to the engine. A float operated control device is provided for maintaining an adequate lubricant level in the delivery tank and an arrangement is incorporated for insuring against operation of the pump in response to momentary changes in liquid level in the delivery tank due to inertial effects.

9 Claims, 5 Drawing Figures

SEPARATE LUBRICATING SYSTEM FOR OUTBOARD MOTORS

BACKGROUND OF THE INVENTION

This invention relates to a separate lubricating system for an outboard motor and more particularly to an improved construction for insuring adequate lubrication for a two-cycle engine.

The lubrication of two-cycle engines presents certain difficulties. Although it has been the conventional practice to mix the lubricant with the fuel, such an arrangement is obviously inconvenient. Furthermore, there is always the danger that an operator will attempt to run the engine on fuel which has not had lubricant added to it, thus damaging the critical components of the engine. It has been, therefore, proposed to provide a separate lubricating system wherein lubricant is delivered from a lubricant pump to the components of the engine to be lubricated. If the engine has multiple cylinders, the use of such separate lubricating systems requires a complex pump with plural discharges amd can add to the size, weight and complexity of the engine.

In an alternative arrangement, it has been proposed to provide a separate lubricating system wherein the lubricant is delivered into the fuel system under pressure by a pump for mixing before induction into the engine. However, where the engine has multipile cylinders and multiple carburetors barrels, this arrangement may not provide uniform lubrication between the various cylinders of the engine.

It is, therefore, a principal object of this invention to provide an improved lubricating system for two-cycle engines.

It is another object of this invention to provide a lubricating system for two-cycle engines wherein lubricant is mixed with the fuel before the fuel is delivered to the carburetor or carburetors of the engine.

In outboard motors, it is a normal practice to employ a two-cycle engine. In addition to the aforenoted lubricating problems, the use of two-cycle engines as outboard motors presents certain challenges toward lubricating the engine. It is desirable to provide a separate lubricating system for outboard motors to achieve the results aforenoted. However, it is difficult to provide the adequate oil supply for long term running within the cowling of the motor. It has, therefore, been proposed to provide a small delivery tank that is contained within the motor and which is supplied from a larger storage tank positioned within the hull of the boat. An arrangement has been provided for insuring an adequate level of lubricant in the delivery tank. However, the motor is subjected to considerable forces when making turns, starting and stopping. The float operated devices heretofore used for maintaining adequate lubricant in the small delivery tank have been sensitive to such changes in direction or speed of travel and can result in malfunctioning under these conditions.

It is, therefore, a further object of this invention to provide an improved lubricating system for an outboard motor.

It is another object of this invention to provide a separate lubricating system for an outboard motor that is not sensitive to changes in speed or direction of travel.

SUMMARY OF THE INVENTION

A first feature of this invention is adapted to be embodied in an induction system for a two-cycle engine including a carburetor for discharging a fuel lubricant mixture into an induction passage associated with the engine and which carburetor has a fuel bowl and fuel delivery means extending from the fuel bowl to the induction passage. In accordance with this feature of the invention, a mixing chamber is positioned externally of the carburetor and means deliver fuel to the mixing chamber and lubricant to the mixing chamber. The pre-mixed fuel lubricant mixture is transferred from the mixing chamber to the carburetor.

Another feature of this invention is adapted to be embodied in a lubricating system for a two-cycle engine comprising a lubricant delivery system for delivering lubricant to the engine. The system includes a relatively small delivery tank for supplying lubricant to the lubricant delivery system of the engine. A separate, large capacity lubricant storage tank is positioned externally of the small delivery tank. Pumping means pump lubricant from the lubricant storage tank to the delivery tank and is operative in response to the liquid level in the delivery tank for maintaining a predetermined level therein. In accordance with this feature of the invention, control means control operation of the pumping means and comprise a lubricant chamber defined within the delivery tank. A float responsive to the level of the lubricant in the lubricant chamber is employed and the pumping member is responsive to changes in position of the float. Means provide restricted communication of lubricant between the lubricant chamber and the remainder of the delivery tank for minimizing fluctuation in the lubricant level due to inertial effects.

DETAILED DESCRIPTION OF THE PREFERRED EMBODIMENT OF THE INVENTION

Figure 1:
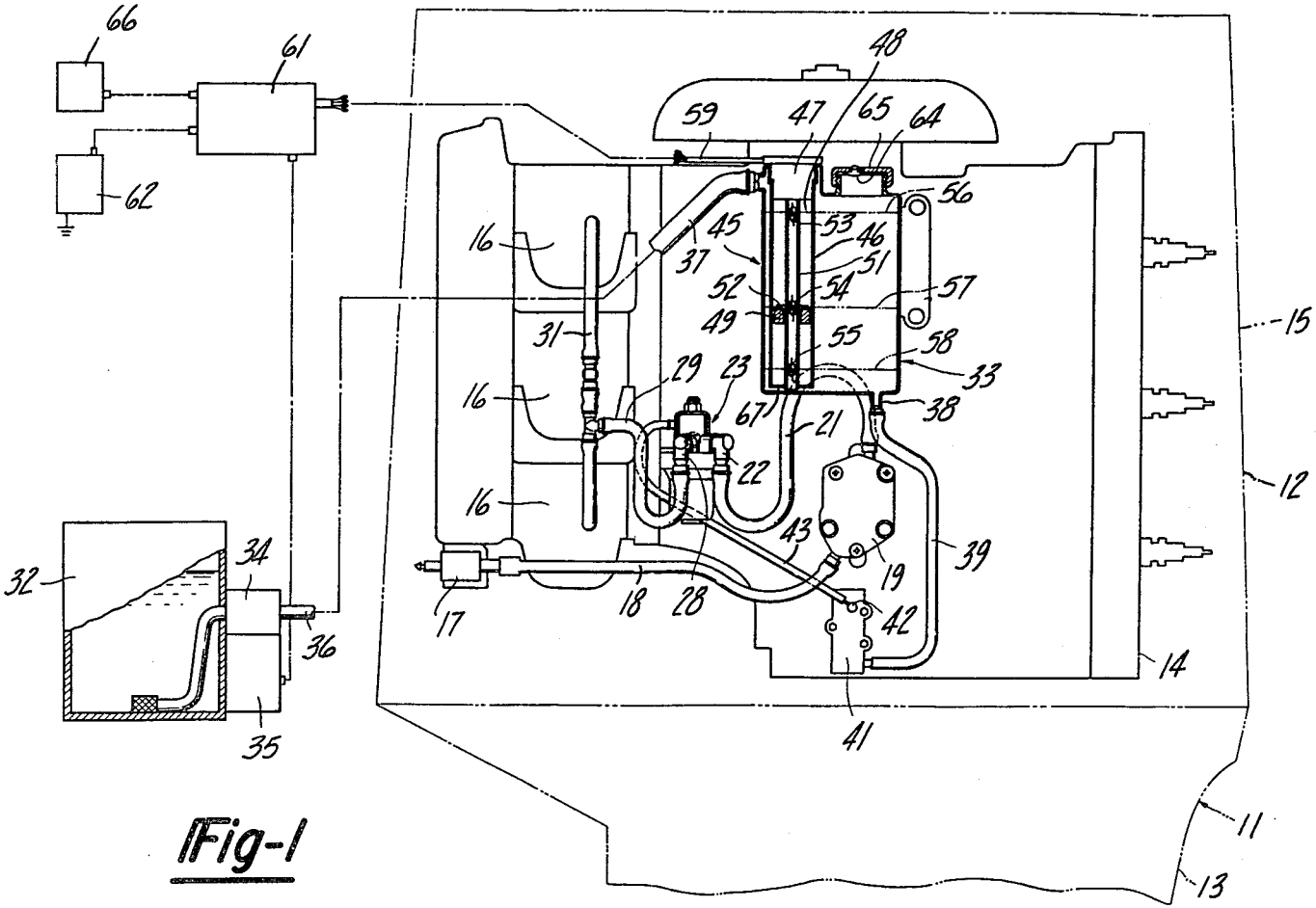
FIG. 1 is a partially schedmatic side elevational view, with portions shown in section, of an outboard motor and associated lubricant and fuel system constructed in accordance with the invention.

Referring first to FIG. 1, an outboard motor constructed in accordance with this invention is shown partially and is identified generally by the reference numeral 11. The outboard motor 11 includes a power head 12 and drive shaft housing 13, which are shown, and a lower unit (not shown). The power head 12 includes an internal combustion engine 14 that is surrounded by a suitable protective cowling 14. Since the invention relates to the lubricating system for the engine, only the outline of the engine 14 has been shown and the associated components of the outboard motor that have nothing to do with the invention have been shown in phantom.

The engine 14, in the illustrated embodiment, is of the three cylinder, two-cycle type. Therefore, the engine 14 has three carburetors 16, each of which supplies a fuel-/air mixture to the crankcases of the respective cylinders for their operation. In accordance with this invention, lubricant is mixed with the fuel before it is supplied to the carburetor 16 so that a fuel lubricant mixture will be delivered to the respective engine cylinders and in equal amounts.

Figure 2:
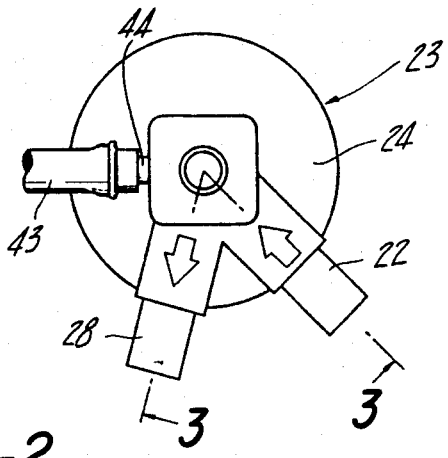
FIG. 2 is a top plan view, on an enlarged scale, of the fuel filter of the engine.
Figure 3:
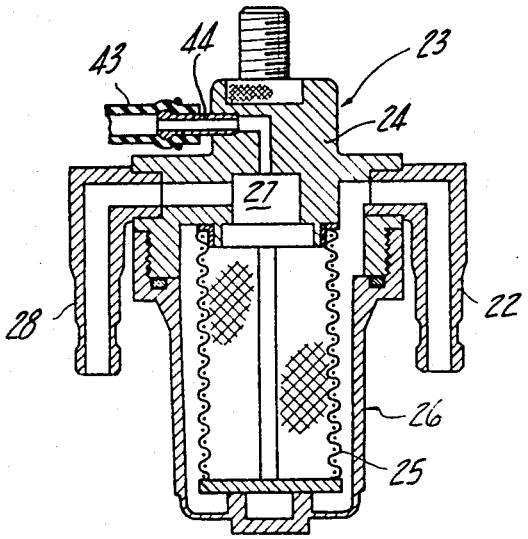
FIG. 3 is a cross-sectional view along the line 3—3 of FIG. 2.

Fuel is supplied for the engine 14 by means of an external hull mounted fuel tank (not shown). Fuel from this tank is delivered to a fitting 17 from the external tank in a known manner. A conduit 18 extends from the fitting 17 to an engine driven fuel pump 19. The fuel pump 19 in turn delivers fuel under pressure through a conduit 21 to an inlet fitting 22 of a fuel filter assembly, indicated generally by the reference numeral 23 and shown in most detail in FIGS. 2 and 3. The fuel filter assembly 23 includes a main mounting portion 24 that supports a filter element 25 of generally annular configuration within a base assembly 26. Fuel is delivered from the inlet 22 into the base 26 and flows radially inwardly through the filter element 25. The filtered fuel is delivered then to a cavity 27 positioned in the mounting portion 24 which, in turn, communicates with an outlet fitting 28.

As shown in FIG. 1, the outlet fitting 28 delivers fuel to a fuel line 29 which, in turn, delivers the fuel to a manifold and conduits 31 for supplying fuel to the individual carburetors 16. Each of the carburetors 16 has a known float operated fuel bowl so as to maintain a uniform level of fuel therein.

In accordance with the invention, an arrangement is provided for adding lubricant to the fuel before it is delivered to the fuel bowls of the carburetors 16. In the illustrated embodiment, this mixing is achieved in the fuel filter assembly 23.

A lubricant supply tank 32 is carried in the hull of the boat. Lubricant is delivered from the supply tank 32 to a delivery tank that is mounted in the cowling 15 adjacent the motor 14 in a manner to be described. The oil delivery tank is indicated by the reference numeral 33. The means for delivering lubricant from the supply tank 32 to the delivery tank 33 includes a pump 34 that is driven by an electric motor 35 and which discharges lubricant through a conduit 36. The conduit 36 has a detachable connection at the engine and terminates in a conduit 37 which discharges into the upper end of the delivery tank 33. A controlling mechanism, to be described, is provided for maintaining a predetermined level of lubricant in the delivery tank 33.

Lubricant is discharged from the delivery tank 33 through a nipple 38 formed in the bottom of the delivery tank 33. A conduit 39 carries the lubricant from the nipple 38 to an engine driven oil pump 41. The oil pump 41 has a single discharge fitting 42 that communicates with a conduit 43 for delivering lubricant to a lubricant inlet fitting 44 (FIGS. 2 and 3) at the top of the fuel filter mounting portion 24. The fitting 44 communicates with an internal conduit in the mounting portion 24 that terminates at the chamber 27. Accordingly, lubricant will be mixed with fuel in the chamber 27 for discharge through the outlet fitting 28 to the fuel bowls of the carburetors.

The level of lubricant in the delivery sump 33 is maintained by a control device, indicated generally by the reference numeral 45. The control device 45 includes a cylindrical housing portion 46 that is dependent from a stopper element 47 that is carried in the upper wall of the tank 33. The cylindrical member 46 defines an internal cavity 48 in which a float 49 is slidably supported on a central post 51. The float 49 carries a magnet 52 at its upper end that is adapted to contact a high level, magnetically responsive switch 53, a low level, magnetically responsive switch 54 and a warning level, magnetically responsive switch 55, each of which is carried by the post 51 and which corresponds to a high lubricant level 56, a low lubricant 57 and a warning lubricant level 58.

A conductor 59 carries a signal from the sensing device 45 to an electronic controller, shown schematically and indicated generally by the reference numeral 61. The controller 61 is in circuit with a battery, shown schematically at 62, and with the electric motor 35 of the oil pump 34. When the float 49 is in such a position that the magnet 52 is in proximity to the switch 54, a signal will be sent to the controller 61 that causes the motor 35 to be energized and run the pump 34 to deliver lubricant to the tank 33.

Figure 4:
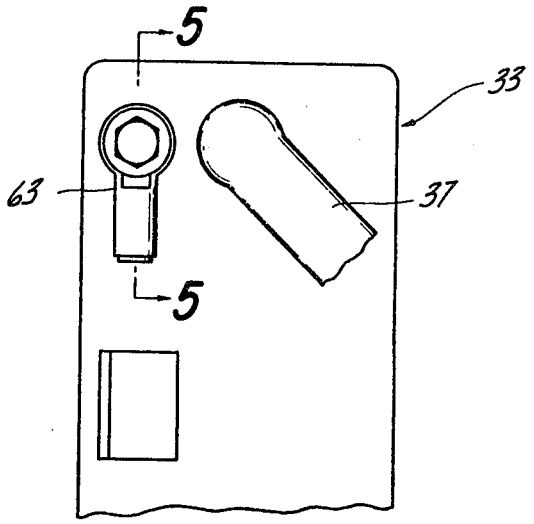
FIG. 4 is an enlarged side elevational view of the delivery tank.
Figure 5:
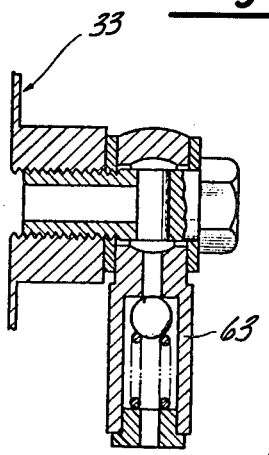
FIG. 5 is a cross-sectional view taken along the line 5—5 of FIG. 4.

A check valve assembly 63 is positioned at a level in the oil delivery tank 33 above the maximum normal level 56 as shown in FIGS. 4 and 5. The check valve 63 will open when oil is being pumped into the tank 33 to raise the level and accommodate the displacement of air under this condition.

When the oil level in the tank 33 reaches the level 56, the magnet 52 will be in proximity to the switch 53 and cause a signal to be transmitted to the controller 61 that will discontinue the supply of electricity to the motor 35 and stop the oil pump 34.

As the oil is consumed from the delivery tank 33 during running of the engine 14, a check valve assembly 64 carried by a cap 65 of the delivery tank 33 will permit air to reenter the tank 33 to make up for the volume of oil that is used. The check valve 64 is of generally inverted umbrella shape and is formed from an elastomeric element. The specific type of check valve employed forms no part of the invention. It is important, however, that the check valve 64 be of a lighter type than the check valve 63. That is, the check valve 64 should open at a lower pressure than the check valve 63 since oil is depleted from the delivery tank 33 at a much slower rate than it is returned to the tank by the pump 34.

Although the check valve 63 will permit air to be dispelled from the delivery tank 33 upon the inflow of oil, the check valve 63 has a high enough opening pressure so as to preclude the discharge of oil if the oil level reaches the mouth of the check valve due to sudden maneuvering. Also, when the engine is tilted up, the check valve 63 will insure against opening and attendant leakage.

If for some reason there is a failure in the pump 34 or the oil level in the storage tank 32 is depleted, oil may fall below the level 57. When the oil reaches the danger level as indicated by the line 58, the magnet 52 will move into proximity to the switch 55 and cause it to send a signal to the controller 61. Under this condition, a warning light or buzzer 66 will be illuminated or sounded so as to give the operator a warning that the oil level has depleted to a dangerous level.

It should be noted that the motor 11 may be subjected to considerable inertial forces, as when rapidly turning, starting or stopping. Such disturbances could very easily cause major fluctuations in the oil level in the delivery tank 33. The sensing device 45, however, is constructed in such a way that it will not be sensitive to such momentary fluctuations in oil level. For this purpose, the bottom end of the tube 46 is closed by means of a closure plug 67. Hence, the cavity 48 is basically isolated from the remainder of the interior of the oil delivery tank 33. Restricted communication is provided between the cavity 48 and the remainder of the delivery tank 33 by means of one or more small openings in the tube 46. Preferably, these openings include small holes located only at the upper and lower ends of the tube 46. In this way, there will be restricted communication between the lubricant in the cavity 48 and that in the remainder of the delivery tank 33 so as to minimize temporary fluctuations due to inertial changes.

It should be readily apparent that the disclosed arrangement insures good and uniform mixing of fuel and lubricant prior to delivery to the fuel bowls of the carburetors 16. Therefore, a relatively simple system is provided which avoids the necessity of using oil pumps having multiple discharge ports and also which dispenses with the necessity of pre-mixing lubricant with the fuel. The disclosed arrangement employing a small delivery tank and a separate larger storage tank minimizes the necessity for refilling of the lubricant while at the same time insuring good lubrication under all conditions. Because of the delivery of lubricant to the fuel in the filter 23, there will be sufficient turbulence induced so as to insure good mixing of the fuel and lubricant. Although the arrangement is disclosed in conjunction with the mixing in the fuel filter, it is to be understood that the invention can be used in conjunction with arrangements wherein the fuel is mixed in some other location prior to delivery to the carburetors and specifically to the fuel bowls of the carburetors. However, it is important that the fuel and lubricant be mixed externally of the carburetors so that the movement of the fuel and lubricant through the conduit to the carburetors will insure good mixing. There is an advantage, however, to having the point of mixing disposed close to the carburetors and that is that the fuel/lubricant mixture will be supplied at the desired ratio under conditions of changes in engine running. That is, when the engine is abruptly accelerated after long periods of slow running such as trowling, the increased amount of lubricant supplied by the pump 41 will be more readily introduced to the engine than if the mixing was at a substantial distance from the carburetor 16.

Although an embodiment of the invention has been illustrated and described, it is believed to be obvious that various changes and modifications may be made without departing from the spirit and scope of the invention as defined by the appended claims.

I claim:

1. In a lubricating system for a two-cycle engine comprising a luricant delivery system for delivering lubricant to the engine, a relatively small delivery tank for supplying lubricant therefrom to said lubricant delivery system, a separate large capacity lubricant storage tank, pumping means for pumping liquid from said lubricant storage tank to said delivery tank, said pumping means being operative in response to the liquid level in said delivery tank for maintaining a predetermined level therein, the improvement comprising control means for operating said pumping means comprising a lubricant chamber defined within said delivery tank, a float responsive to the level of lubricant in said lubricant in said lubricant chamber, means for operating said pumping member in response to changes in position of said float, and means for providing restricted communication of lubricant between said lubricant chamber and the remainder of said delivery tank for minimizing fluctuations of lubricant level due to inertial effects.

2. In a lubricating system as set forth in claim 1 wherein the means for providing restricted communication comprises a restricted opening in a wall of a member defining the lubricant chamber and containing the float, said opening being positioned at the lower end of said lubricant chamber.

3. In a lubricating system as set forth in claim 2 wherein the member comprises a cylindrical member and the float comprises a cylindrical float slidably supported on a post extending throgh said cylindrical member.

4. In a lubricating system as set forth in claim 1 wherein the means responsive to the changes of position of the float comprise means for starting the opertion of the pump when the level of lubricant in the lubricant chamber is below a predetermined level and stopping the pump when the level of lubricant in the lubricant chamber is above a certain level.

5. In a lubricating system as set forth in claim 4 further including means for providing a warning signal when the level of the lubricant in the lubricant chamber falls below a predetermined level.

6. In a lubricating system as set forth in claim 5 wherein the signal is provided by a magnetic switch positioned at each of the levels and which is actuated by a magnet carried by the float.

7. In a lubricating system as set forth in claim 6 wherein the means for providing restricted communication comprises an restricted opening in a wall of a member defining the lubricant chamber and containing the float, said opening being positioned at the lower end of said lubricant chamber.

8. In a lubricating system as set forth in claim 7 wherein the member comprises a cylindrical member and the float comprises a cylindrical member slidably supported on a post extending through said cylindrical member.

9. In a lubricating system as set forth in claim 8 wherein the lubricant is delivered from the delivery tank to a point in the fuel line of the associated engine upstream of the carburetor thereof for mixing fuel with the lubricant before delivery to the carburetor.

* * * * *